United States Patent [19]

Humphrey et al.

[11] Patent Number: 4,980,670

[45] Date of Patent: Dec. 25, 1990

[54] DEACTIVATABLE E.A.S. MARKER HAVING A STEP CHANGE IN MAGNETIC FLUX

[75] Inventors: Floyd Humphrey, Meredith, N.H.; Jiro Yamasaki, Fukuoka, Japan

[73] Assignee: Sensormatic Electronics Corporation, Deerfield Beach, Fla.

[21] Appl. No.: 117,210

[22] Filed: Nov. 4, 1987

[51] Int. Cl.[5] ..... G08B 13/24

[52] U.S. Cl. ..... 340/551; 340/572

[58] Field of Search ..... 340/551, 572

[56] References Cited

U.S. PATENT DOCUMENTS

| | | | |
|---|---|---|---|
| 4,581,524 | 4/1986 | Hoekman et al. | 340/572 |
| 4,660,025 | 4/1987 | Humphrey | 340/572 |
| 4,686,516 | 8/1987 | Humphrey | 340/572 |

OTHER PUBLICATIONS

Yamasaki, J. et al., "Domain Wall Induced Anisotropy During Annealing in Amorphous Ribbons," *IEEE Transactions on Magnetics,* vol. Mag.-20, No. 5, Sep. 1984.

*Primary Examiner*—Glen R. Swann, III

*Attorney, Agent, or Firm*—Robin, Blecker, Daley & Driscoll

[57] ABSTRACT

A magnetic marker is formed from a magnetic material having a hysteresis characteristic which is such that upon subjecting the material to an applied alternating magnetic field, the magnetic flux of the material undergoes a regenerative step change in flux at a threshold value when the field increases to the threshold value from substantially zero and undergoes a gradual change in flux when the field decreases from the threshold value to substantially zero. For increasing values of applied field below the threshold, there is substantially no change in the magnetic flux of the material. The aforesaid hysteresis characteristic of the marker is achieved by causing the material to have domains with a pinned wall configuration. Deactivation of the marker is realized by disabling the pinned walls from returning to their pinned condition via application of a deactivation field of high frequency and/or amplitude.

69 Claims, 3 Drawing Sheets

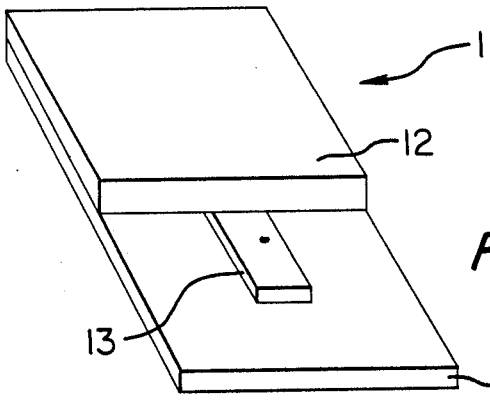
FIG. 1
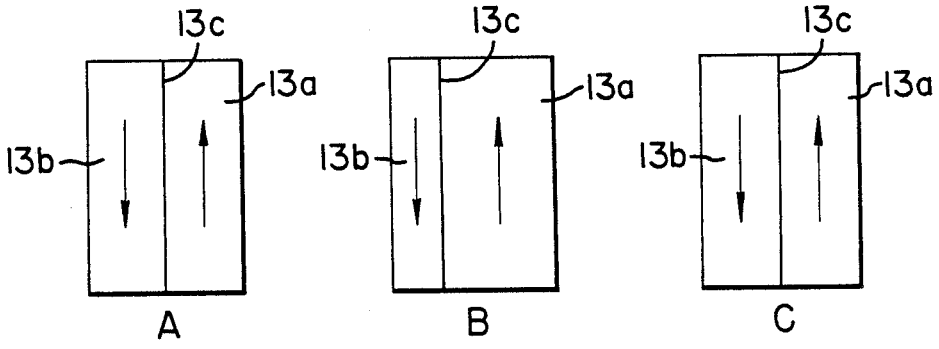
FIG. 2
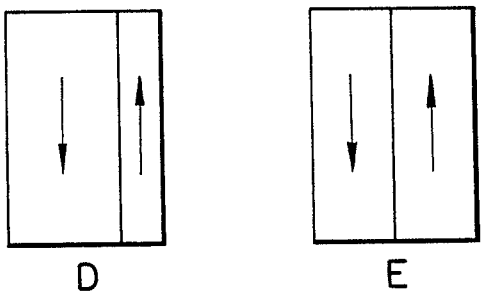

DEACTIVATABLE E.A.S. MARKER HAVING A STEP CHANGE IN MAGNETIC FLUX

BACKGROUND OF THE INVENTION

This invention relates to electronic article surveillance systems using magnetic phenomena and, in particular, to markers, methods and apparatus for use in such article surveillance systems.

Electronic article surveillance systems in which magnetic markers are used to detect the presence of articles under surveillance are well known in the art. French patent No. 763,681 to Picard discloses an early system of this type. The Picard patent teaches that low coercive force, high permeability metals, such as permalloy, when subjected to an alternating magnetic field induce harmonics which distinguish these metals from other magnetic metals. These metals with their unique harmonics can thus be used as magnetic markers to identify objects which carry the markers.

Since the early days of the Picard patent, substantial effort has been expended in an attempt to improve the existing markers. This effort, for the most part, has been directed at finding new materials having a lower coercive force and higher permeability than was previously used. Because the voltage pulse generated by the presence of the marker is dependent on the hysteresis characteristic of the magnetic material of the marker, by using materials with lower coercive force and higher permeability, higher order harmonics with higher amplitude values could be realized for lower values of applied field, thereby making the markers more distinguishable.

While the search for materials with higher permeability and lower coercive force was thus the direction of most researchers, a radically different approach is presented in U.S. Pat. No. 4,660,025, entitled "Article Surveillance Magnetic Marker Having an Hysteresis Loop With Large Barkhausen Discontinuities", and assigned to the same assignee hereof. In the '025 patent, a magnetic marker is disclosed which does not depend upon a high permeability, low coercive force material. Furthermore, the output pulse developed in response to the presence of the marker is substantially independent of the time rate of change of the interrogating field and the field strength as long as the field strength exceeds a low minimum threshold value. More particularly, the '025 patent teaches that by forming the marker so that the magnetic material of the marker retains stress, the marker exhibits a hysteresis characteristic having a large Barkhausen discontinuity. Accordingly, upon exposure to an interrogating field exceeding the low threshold value, the magnetic polarization of the marker undergoes a regenerative reversal. This so-called "snap action" reversal in the magnetic polarization results in the generation of a sharp voltage pulse, rich in high harmonics, which affords a more distinguishable detectable signal.

In addition to the highly advantageous harmonic content and pulse output of the marker of the '025 patent, the marker is also advantageous in that it allows for deactivation by a number of techniques. These techniques are disclosed in U.S. Pat. No. 4,686,516, entitled "Method, System and Apparatus for Article Surveillance", and also assigned to the same assignee hereof. More particularly, the '516 patent discloses one practice for deactivating the marker of the '025 patent in which the amorphous material of the marker is crystallized.

This is accomplished by heating at least a portion of the marker above the crystallization temperature, either by application of an electric current or radiant energy such as laser light. Another procedure disclosed in the '516 patent and useable with this type of marker involves the application of mechanical or radiant energy means to relieve the internal stress in the marker. While some of these deactivation procedures enable deactivation without touching the marker, they also require careful application of the deactivation energy so that the energy is not blocked from reaching adjacent articles.

It is therefore a primary object of the present invention to provide an improved magnetic marker for electronic article surveillance systems wherein the marker undergoes snap action or step changes in its magnetic flux at low threshold values of the applied field, while also being hands-off (i.e., non-contact) deactivatable by simple means.

It is a further object of the present invention to provide a method of making the aforementioned improved magnetic marker.

It is still a further object of the present invention to provide an electronic article surveillance system incorporating the aforementioned improved magnetic marker.

It is yet a further object of the present invention to provide an electronic article surveillance system incorporating both deactivation means and the aforementioned improved magnetic marker.

SUMMARY OF THE INVENTION

In accordance with the principles of the present invention the above and other objectives are achieved in a marker comprising a magnetic material or means which is conditioned to have a hysteresis characteristic of preselected character. Specifically, when subjected to an alternating magnetic field, the magnetic flux of the material undergoes a regenerative step change at a threshold value when the field increases to the threshold value from substantially zero and undergoes a gradual change when the field decreases from the threshold value to substantially zero. For field values below the threshold, there is substantially no change in the magnetic flux of the material.

In the present illustrative form of the invention, the aforesaid characteristic is realized by conditioning the marker magnetic material to having a domain structure of preselected character. In particular, the domain structure of the magnetic material is such that it remains unchanged, i.e., the domain walls are in a pinned state, corresponding to a demagnetized or neglible flux condition of the magnetic material, for increasing magnitudes of applied field up to the aforementioned threshold value. At this threshold, the pinned walls become released, i.e., snap from their pinned condition, causing the flux of the magnetic material to undergo a regenerative step change in value. As the magnitude of the applied field is subsequently decreased below the threshold value, the flux is gradually decreased to the demagnetized or negligible flux condition and the domain walls are returned to their pinned state.

Due to the step change in flux of the magnetic material, the marker of the invention induces perturbations in an applied interrogation field which are rich in high harmonics and which are relatively independent of the field, analogous to the marker of the '025 patent. Furthermore, because the marker depends on step changes in flux to generate perturbations to the field, the marker can be deactivated by means which causes the step changes to be replaced by gradual changes.

In the aforementioned, pinned domain wall form of the invention, this deactivation can be easily realized by further conditioning which significantly diminishes the ability of the domain walls to return to and remain in their pinned state. In accordance with the practices disclosed herein, such further conditioning is realized by application of a deactivating magnetic field whose frequency and/or amplitude are substantially higher than the respective frequency and/or amplitude of the interrogating field.

In a further aspect of the present invention a method of making or conditioning the aforesaid marker of the invention to have the desired pinned wall domain configuration is disclosed. In yet further aspects of the invention, an electronic article surveillance system and method incorporating the marker and deactivation means for the marker are also disclosed.

DESCRIPTION OF THE DRAWINGS

The above and other features and aspects of present invention will become more apparent upon reading the following detailed description in conjunction with accompanying drawings, in which:

FIG. 1 shows a tag incorporating a magnetic marker in accordance with the principles of the present invention;

FIGS. 2A–2E illustrate, in simplified form, the magnetic domain configuration of the marker of FIG. 1 for various values of applied field;

DETAILED DESCRIPTION

In FIG. 1, a tag 1 in accordance with the principles of the present invention is shown. The tag 1 comprises a substrate 11 and an overlayer 12 between which is disposed a magnetic marker 13 comprising a magnetic material. The undersurface of the substrate 11 can be coated with a suitable pressure sensitive adhesive for securing the marker 13 to an article to be maintained under surveillance. Alternatively, any other known arrangement can be employed to secure the marker 13 to the article.

In accordance with the invention, the magnetic marker 13 of the tag 1 is conditioned so as to have a hysteresis characteristic of preselected character. More specifically, in accordance with the present illustrative form of the invention, this characteristic is realized by conditioning the marker to exhibit a predetermined or preselected domain structure with pinned domain walls when the marker is in a demagnetized or negligible flux condition. This domain structure is retained by the pinned walls for magnitudes of applied field up to a threshold value at which time the pinned walls release and the structure abruptly changes, causing a corresponding regenerative step change or transition in flux. As the magnitude of the applied field subsequently decreases below the pinning threshold to a value which again results in a neglible flux or demagnetized condition, the domain structure returns to its equilibrium state wherein the domain walls are again pinned.

Figure 3:
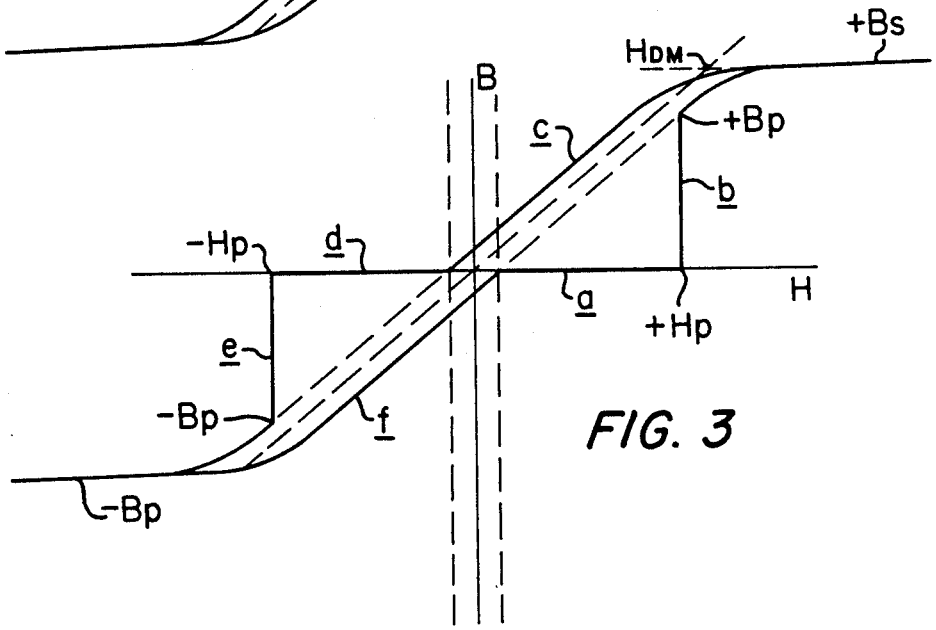
FIG. 3 shows the hysteresis characteristic of the marker of FIG. 1.

FIG. 2 illustrates pictorially in A–E a simplified domain structure for the marker 13 and how the structure changes with applied field. FIG. 3, in turn, illustrates the resultant desired hysteresis characteristic. In the simplified domain structure of FIG. 2, a single domain wall **13*c* extends along the length of the marker 13 initially centrally of its width to define equal size domains 13*a* and 13*b*. However, in actual practice, the domain structure can take on any desired shape, although structures having relatively simple domain walls of long length are considered preferable. The hysteresis characteristic in FIG. 3** is also pictorial in nature and no attempt has been made to draw the characteristic to scale or in scale proportions.

As can be appreciated from FIGS. 2 and 3, in the initial demagnetized condition of the marker 13 (depicted in A of FIG. 2), the magnetic polarizations of the initially equal size domains **13*a*, 13*b* of the marker 13 are of opposite first and second directions (hereinafter referred to as the "positive" and "negative" directions, respectively) resulting in a substantially negligible flux. As the applied magnetic field increases in the positive direction, the domain wall 13*c* separating the domains 13*a*, 13*b* remains unchanged or pinned in position so that the neglible flux condition persists as evidenced by the portion a of the hysteresis characteristic of FIG. 3. When the field reaches the positive pinning threshold $+H_p$, however, the wall 13*c* abruptly releases, shifting to the left so that the positive direction polarization domain 13*a* becomes larger than the negative direction polarization domain 13*b*. This causes the marker 13 to abruptly take on an overall positive magnetic polarization and to thereby result in a step positive change in the magnetic flux. Curve portion b in FIG. 3** depicts this and shows that the flux has undergone a step transition or jump at the applied field of $+H_p$ to a positive flux $+B_p$ near the positive saturation $+B_s$.

Reduction of the applied field below the positive pinning threshold $+H_p$ now causes the flux to gradually decrease (i.e., undergo a smooth "transformer like" characteristic) to a neglible flux condition corresponding to the demagnetized state of the marker 13, as evidenced by curve portion c in FIG. 3. During this time, the domain wall **13*c*, which is no longer pinned, gradually returns to its original pinned position or site to again become pinned, as shown in C of FIG. 2, causing the domains 13*a*, 13*b* to also take on their original shape. As the applied field is now reversed in direction, the wall 13*c* of the marker 13 remains pinned and the demagnetized or neglible flux condition again persists as shown by the curve portion d in FIG. 3. Upon reaching the negative pinning threshold $-H_p$, the wall 13*c* abruptly releases, this time shifting to the right causing the negative direction polarization domain 13*b* to be enlarged relative to the positive direction polarization domain 13*a* (D of FIG. 2). The marker thus abruptly takes on an overall negative direction polarization, thereby causing the flux to undergo a negative step transition or change as can be seen by the curve portion e of FIG. 3. The flux thus takes on a negative value $-B_p$ close to the negative saturation value $-B_s$. Decrease of the negative field then causes a gradual decrease of the flux along curve portion f in FIG. 3 to the demagnetized or neglible flux condition and the wall 13c of the marker 13** again returns to its pinned state as shown in E of FIG. 2.

The pinning threshold value $H_p$ evidenced by the marker 13 is established during conditioning of the marker and, preferably, is less than about 1.0 oersted. It is also preferable that the demagnetizing field of the marker 13 be less than about 1.0 oersted and, more preferably, be within a range of 0.5 to 0.8 oersted. The lower limit desired for the demagnetizing field ensures that the effects of the earth's magnetic field on the marker are minimized, while the upper limit ensures that the drive of the applied field is within acceptable limits. It is further preferable for optimum operation that the demagnetizing field be equal to or slightly less than the pinning threshold $H_p$.

Figure 5:
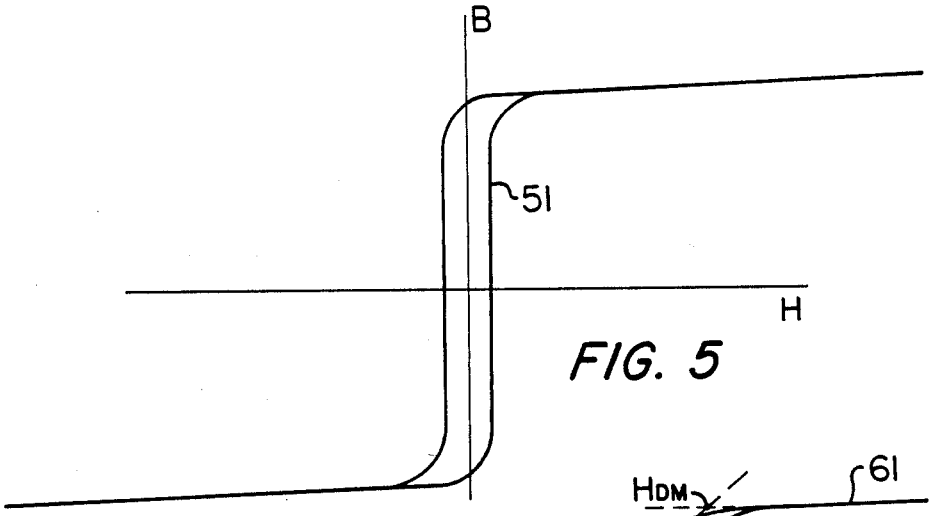
FIG. 5 illustrates the hysteresis characteristic of a continuous length of magnetic material useable in forming the marker of FIG. 1.

The demagnetizing field of the marker 13 is the field which arises in the marker in opposition to the applied field and is a result of the finite length of the marker. Before the magnetic material forming the marker 13 is cut into lengths suitable for the marker, the material exhibits a hysteresis characteristic 51 as shown in FIG. 5. This characteristic evidences no demagnetizing field for the material. Once the material is cut into finite lengths, however, the hysteresis characteristic tilts as shown by curve 61 in FIG. 6 evidencing a demagnetizing field $H_{DM}$ which is determined by the intersection of the dotted line 62 with the extrapolation of 61. Subsequent conditioning of the marker material, as will be described below, to realize the domain configuration described above for the marker 13, results in substantially the same demagnetizing field $H_{DM}$ but with the altered hysteresis characteristic for marker depicted in FIG. 3.

Control over the demagnetizing field of the marker 13 to achieve the field values discussed above can be realized by varying the shape of the marker. Markers with dimensions of 5 centimeters in length, 2 millimeters in width and 28 microns in thickness have resulted in a demagnetizing field of 0.5 oersted. Conditioning of these markers has also resulted in a pinning threshold of substantially the same value. It is believed that ribbons having a 2 inch length, a 0.25 inch width and a 28 micron thickness could result in a demagnetizing field and pinning threshold of about twice this value, i.e., of about 1.0 oersted. Thus, the markers of the invention, while long and narrow, will likely not be required to be as extreme in length as the markers of conventional tags in present use.

As can be seen from the above, the marker 13 of the invention, due to its unique domain wall character and corresponding hysteresis characteristic, exhibits step flux transitions at relatively low values of applied field, i.e., less than about 1.0 oersted. These step transitions will result in perturbations in an applied field which will generate a sharp voltage pulse, rich in high harmonics, which affords a more distinguishable detectable signal analogous to the signals realized with the marker of the '025 patent.

The magnetic material of the marker 13 can be any material or combination of materials which exhibit the hysteresis characteristic of FIG. 3. Thus, crystalline magnetic materials, such as Permalloy if adapted in this manner may be used. Similarly, amorphous magnetic materials adapted in this manner may also be used. Furthermore, while non-magnetostrictive amorphous materials would be preferable, certain positive magnetostrictive materials might also be useable.

Amorphous materials of the following compositions have exhibited the desired pinned wall properties:

$Co_{72.15}Fe_{5.85}Si_5B_{15}Mo_2$ (W)

$Co_{75.2}Fe_{4.8}Si_2B_{18}$ (X)

$Co_{74.26}Fe_{4.74}Si_3B_{18}$ (Y)

$Co_{74.24}Fe_{4.76}Si_2B_{19}$ (Z)

In a marker formed from the composition (Y) above, the marker exhibited a demagnetizing field of 0.3 oersted, a pinning threshold of 0.5 oersted and a saturation field of 1.0 oersted.

Figure 4:
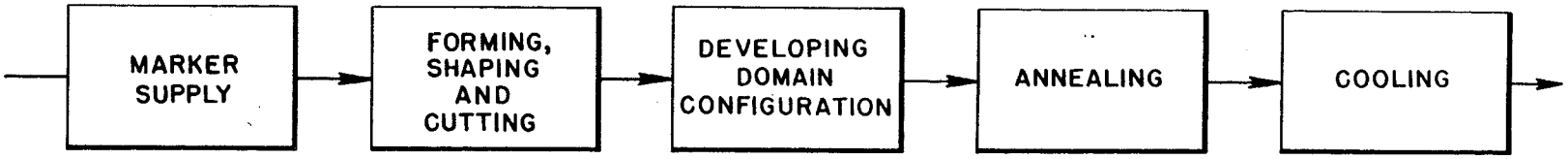
FIG. 4 shows the process steps for making the marker of FIG. 1.

As indicated above, the conditioning or fabrication procedure for the marker 13 of the tag 1 enables the marker to exhibit the desired domain wall and hysteresis properties discussed above. FIG. 4 illustrates the steps in the conditioning process or method. Magnetic marker material from a supply, is first formed into a continuous body by a standard forming procedure. This procedure will be dictated by the shape desired for the marker, i.e., whether the marker is to have the shape of a ribbon, wire, sheet, film or some other shape. The magnetic marker material as supplied is usually free of spurious domain structure caused by local strains and imperfections. If spurious domain structure is found to exist at this point the material can be heated, i.e., preannealed, to achieve a strain free material.

The continuous body after forming is cut into lengths desired for the particular markers being fabricated. The marker lengths are then further processed to develop the desired domain configuration. This configuration is then fixed in the markers by annealing and the annealed markers are then cooled to complete the process.

The step of developing the desired domain configuration in each marker can be achieved in a variety of different ways. One technique is to subject the marker to a varying magnetic field and then to either slowly decrease the field or slowly remove the marker from the field to demagnetize the marker. This will create a domain structure in the marker corresponding to a demagnetized, negligible flux condition and the particular structure can be tailored by adjusting the shape of the marker and/or the application of the applied field. If the domain structure is created in this manner, the subsequent annealing and cooling steps are required to be carried out in a substantially field free environment. This, in turn, requires that the environment be shielded from the earth's magnetic field or, if shielding is not possible, that the earth's field be balanced out.

Another technique for developing the desired domain structure is to apply a magnetic field to the marker and hold the field and marker in a fixed relationship which is continued through the subsequent annealing and cooling steps. Thus, the marker and a group of magnets can be held in a jig, for example, to provide the desired configuration. The jig can then be placed in the annealing equipment and the cooling equipment so that the domain configuration is maintained, while the configuration is being fixed in the ribbon.

As mentioned above, FIG. 6 illustrates the hysteresis characteristic of the marker 13 material after it has been cut to length, but prior to development of the desired domain structure. As is apparent, the marker exhibits the normal hysteresis with no step transitions in flux. After development of the domain pattern and annealing to fix the pattern, the hysteresis changes to that shown in FIG. 3, as above-described.

The temperatures and time periods suitable for the annealing step in the conditioning of the marker 13 will depend upon the factors surrounding the particular situation. Markers have been fabricated with temperatures of 300 degrees C. over time periods of 20 minutes, 30 minutes and 1 hour and with temperatures of 400 degrees C. over time periods of 30 minutes. A useable range of temperatures and time periods might be 250–500° C. and 30 seconds to 5 minutes. Of course, the annealing temperature must be less than the Curie temperature and, if the magnetic material is amorphous, also less than the crystallization temperature.

While, as discussed above, the marker 13 of the invention is advantageous in developing high harmonics which are relatively independent of the applied field for low values of the field, the marker is further advantageous in that it can be readily deactivated without the need to physically touch the marker. In accord with the invention, this can be accomplished by subjecting the marker 13 to means which changes the step flux transitions in the marker hysteresis characteristic to gradual changes. In the present illustrative form of the invention, this is realized by means which prevents the domain walls of the marker from returning to their pinned equilibrium state or sites as the applied field is decreased to the demagnetized, negligible flux condition. In further accord with the invention, deactivation is preferably achieved simply by applying a deactivating field to the marker which is adjusted in magnitude and/or frequency to disrupt or break up the domain configuration so the domain walls are unable to find their pinning sites.

Again, as with the conditions for annealing, the particular frequency and/or amplitude of the field required to deactivate the marker 13 will depend upon the factors attendant each situation. However, the lowest deactivation frequency and/or amplitude should be at least sufficiently greater than the frequency and/or amplitude, respectively, of the field used for interrogation that the latter can be accomplished without the fear of deactivating the marker. For the marker in the example discussed hereinabove, (i.e., the marker of (Y) composition with the 0.3 oersted demagnetizing field) a deactivating field of 10 oersted was found sufficient to deactivate the ribbon. Another marker having the composition (Z) above and operating in an interrogation field of 10 Hz. frequency was able to be deactivated with an applied field of 1 kHz frequency at 3.0 oersted. By making the amplitude and/or frequency of the deactivating field at least an order of magnitude greater than the respective amplitude and frequency of the interrogation field proper operation is reasonably assured.

Figure 6:
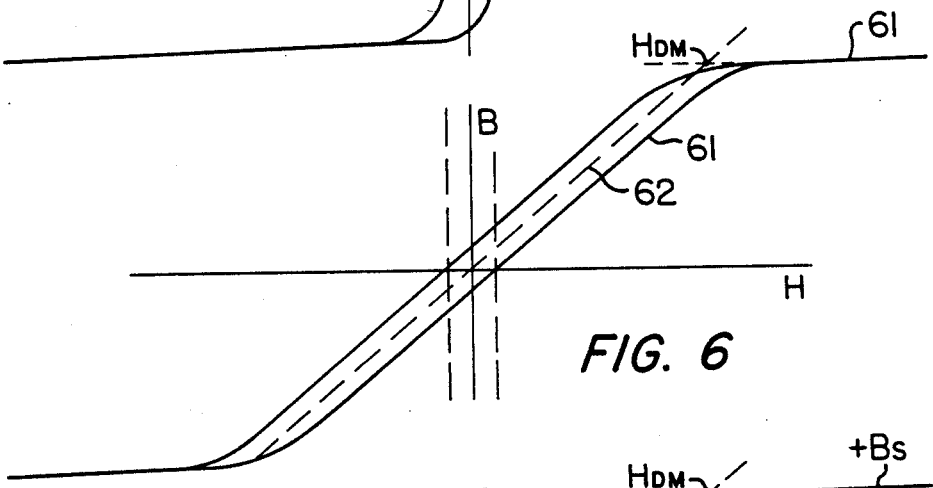
FIG. 6 illustrates the hysteresis characteristic of the magnetic material of FIG. 5 after the material has been cut into lengths suitable for the marker of FIG. 1, but prior to being conditioned in accordance with the method of the invention

When the aforementioned high frequency or high amplitude field is applied to the marker 13, the marker is caused to reverse magnetic polarity in a short time. In order to accommodate this, the domain walls of the marker are forced to break up creating more walls to reverse more quickly. The original wall configuration is thus destroyed. As a result, the wall configurations in the flux states corresponding to the characteristic positions where c and f reach the demagnetized or negligible flux state in FIG. 3, no longer match the configurations originally annealed into the marker. The walls, therefore, do not find their pinning sites, thereby resulting in a hysteresis characteristic which is similar to the characteristic prior to development of the pinned domain wall configuration, i.e., a characteristic as illustrated in FIG. 6. The marker, therefore, no longer provides a rich high harmonic response and acts like a piece of normal magnetic material.

Figure 7:
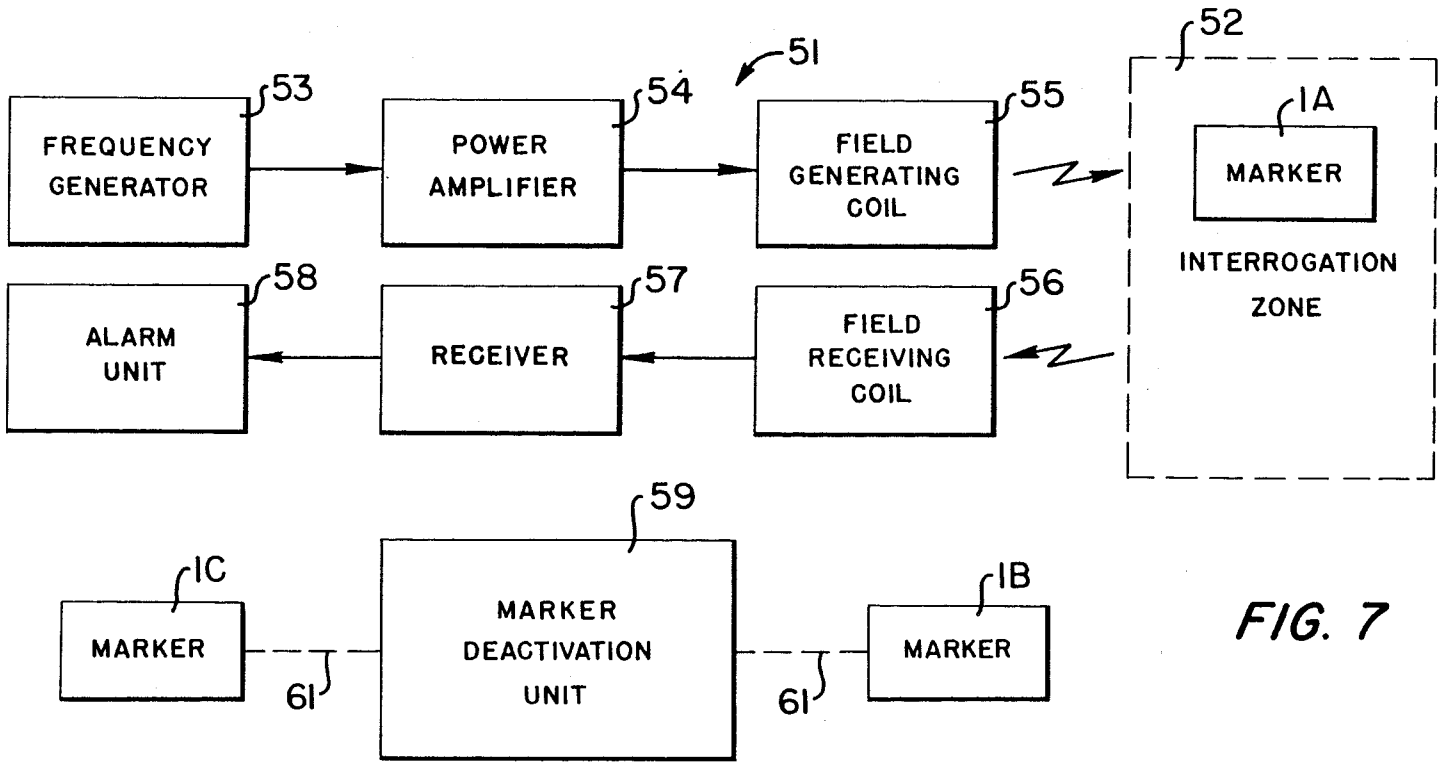
FIG. 7 illustrates an electronic article surveillance system including a deactivation unit and incorporating the marker of FIG. 1.

FIG. 7 illustrates use of the tag 1 in an article surveillance system provided with a deactivation unit. More particularly, the system 51 includes an interrogation or surveillance zone, e.g., an exit area of a store, indicated by the broken lines at 52. Tag 1A having attributes similar to the tag 1 of the invention is shown attached to an article in the zone 52. The transmitter portion of the system comprises a frequency generator 53 whose output is fed to a power amplifier 54 which, in turn, feeds a field generating coil 55. The latter coil establishes an alternating magnetic field of desired frequency and amplitude in the interrogation zone 52. The amplitude of the field will of course vary depending upon system parameters, such as coil size, interrogation zone size, etc. However, the amplitude must exceed a minimum field so that tags in the zone 52 will under all conditions see a field above the aforementioned pinning threshold. A typical minimum field is about 1.2 oersted.

The receiving portion of the system includes field receiving coils 56, the output of which is applied to a receiver 57. When the receiver detects harmonic content in signals received from coils 56 in a prescribed range and resulting from the tag 1A, the receiver furnishes a triggering signal to alarm unit 58 to activate the alarm.

It should be noted that the receiver portion of the system 51 should have a response time which is sufficiently fast to detect the tag 1A before the marker is brought to locations in the interrogation zone 52 where the level of the field may be sufficient to deactivate the tag (e.g., locations closely adjacent the generating coil 55). Upon such detection, the system 51 can then adjust the transmitting portion to reduce the field in order to avoid deactivation. Alternatively, the system can be maintained at its original field level so that deactivation of the tag 1A occurs after detection.

A second tag 1B also having attributes similar to the tag 1 of the invention is shown on an article outside the interrogation zone 52 and therefore not subject to the interrogation field established in this zone. An authorized checkout station includes a tag deactivation unit 59. The tag 1B is to be deactivated by passage along path 61 through the deactivating unit 59. Passage of the tag 1B results in a deactivated tag 1C, which may now pass freely through the interrogation zone 52 without acting upon the interrogation field in a manner triggering the alarm 58.

As can be appreciated the deactivation unit 59 may simply comprise a magnetic field generator with a frequency and/or amplitude sufficient to disable the pinned state of the domain configuration of the tag 1B to result in the deactivated tag 1C.

It should be noted that the magnetic marker 13 can take on a variety of shapes and configurations. Thus, the marker can be in the form of a ribbon, wire, sheet, film or other configuration.

As above indicated, the marker 13 of the invention can be of shorter length than conventional markers, while providing a higher signal output. Moreover, by varying the size and shape of the marker it can be readily adapted to accommodate a variety of environments as well as a variety of different surveillance system parameters. These advantages coupled with the ability to readily deactivate the marker without touching it make it useable in a variety of applications, including use in price stickers on products.

In all cases it is understood that the above-identified arrangements are merely illustrative of the many possible specific embodiments which represent applications of the present invention. Numerous and varied other arrangements can readily be devised in accordance with the principles of the invention without departing from the spirit and scope of the invention.

What is claimed is:

1. A marker for use in an article surveillance system in which an alternating magnetic interrogation field is established in a surveillance zone and an alarm is activated when a predetermined perturbation to said field is detected, said marker comprising a magnetic material having a hysteresis characteristic with a step change in magnetic flux such that upon subjecting the magnetic material to an applied alternating magnetic field, the magnetic flux of the magnetic material undergoes a regenerative step change in magnetic flux at a threshold value when the field increases to the threshold value from substantially zero and undergoes a gradual change in magnetic flux when the field decreases from the threshold value to substantially zero, the magnetic flux of the material undergoing substantially no change in flux value for increasing values of field below the threshold value.

2. A marker in accordance with claim 1 wherein:
the regenerative step change in flux becomes a gradual change after said marker is subjected to an applied field of amplitude above a predetermined value.

3. A marker in accordance with claim 1 wherein:
the regenerative step change in flux becomes a gradual change after said marker is subjected to an applied field of frequency above a predetermined value.

4. A marker in accordance with claim 1 wherein:
said hysteresis characteristic of said magnetic material:
(A) exhibits a negligible flux for first direction values of applied field up to said threshold;
(B) exhibits a step transition first direction change in flux at the first direction value of the applied field equal to said threshold value;
(C) exhibits a gradual decrease in flux to said negligible flux for a decrease in the first direction values of applied field below the field value equal to said threshold value;
(D) exhibits said negligible flux for second direction value of applied field up to said threshold value, said second direction being opposite said first direction;
(E) exhibits a step transition second direction change in flux at the second direction value of the applied field equal to said threshold value; and
(F) exhibits a gradual decrease in flux to said negligible flux for a decrease in the second direction values of applied field below the value equal to said threshold value.

5. A marker in accordance with claim 1 wherein:
said magnetic material has, when in substantially demagnetized condition corresponding to a negligible flux, domains whose wall configuration is in a pinned state and remains in a pinned state for increasing magnitudes of applied field up to the threshold value at which the wall configuration is released from the pinned state causing said regenerative step change in the magnetic flux, the wall configuration returning to the pinned state upon the magnitude of applied field being decreased below the threshold value to a value resulting in said demagnetized condition whereby said flux is gradually decreased to the negligible flux.

6. A marker in accordance with claim 5 wherein:
the wall configuration of the said magnetic material is such that when said magnetic material is subjected to a frequency of applied field above a certain frequency, the wall configuration is disabled from returning to its pinned state.

7. A marker in accordance with claim 5 wherein:
the wall configuration is such that when said magnetic material is subjected to an amplitude of applied field above a certain amplitude, the wall configuration is disabled from returning to its pinned state.

8. A marker in accordance with claim 5 wherein:
said wall configuration of the domains comprises a domain wall extending along the length said of said magnetic material centrally of the width of said magnetic material.

9. A marker in accordance with claim 5 wherein:
the domains with the pinned state for their wall configuration are annealed into said magnetic means.

10. A marker in accordance with claim 9 wherein:
said annealing is at a temperature in the range of 250°–500° C. for a period of time in the range of 30 seconds to 5 minutes.

11. A marker in accordance with claim 5, in combination with means for generating an alternating magnetic interrogation field in an interrogation zone, and means for detecting the perturbation to said magnetic interrogation field resulting from said marker for activating an alarm.

12. A marker in accordance with claim 11, in further combination with:
means for deactivating the marker by disabling the wall configuration from returning to its pinned state.

13. A marker in accordance with 12 wherein:
said deactivating means comprises means for applying a deactivating magnetic field to the marker.

14. A marker in accordance with claim 13 wherein:
the amplitude of said deactivating magnetic field is equal to or above about an order of magnitude greater than the amplitude of said magnetic interrogation field.

15. A marker in accordance with claim 13 wherein:
the frequency of said deactivating magnetic field is equal to or above about an order of magnitude greater than the frequency of said magnetic interrogation field.

16. A marker in accordance with claim 1 wherein:
the magnetic material has a demagnetizing field which is equal to or slightly less than said threshold value.

17. A marker in accordance with claim 16 wherein:
said demagnetizing field is in a range of 0.5 to 0.8 oersted.

18. A marker in accordance with claim 1 wherein:
said magnetic material comprises an amorphous magnetic material.

19. A marker in accordance with claim 18 wherein: said magnetic material is non-magnetostrictive.

20. A marker in accordance with claim 18 wherein: said magnetic material has the composition $Co_{74.2}Fe_{4.74}Si_3B_{18}$.

21. A marker in accordance with claim 18 wherein: said magnetic material has the composition $Co_{74.2}Fe_{4.76}Si_2B_{19}$.

22. A marker in accordance with claim 18 wherein: said magnetic material has the composition $Co_{75.2}Fe_{4.8}Si_2B_{18}$.

23. A marker in accordance with claim 18 wherein: said magnetic material has the composition: $Co_{72.15}Fe_{5.85}Si_5B_{15}Mo_2$.

24. A marker in accordance with claim 1 wherein: said threshold value is below about 1.0 oersted.

25. A marker in accordance with claim 24 wherein: said threshold value is in the range of 0.5 to 1.0 oersted.

26. A marker in accordance with claim 1 wherein: said marker is in the form of one of a ribbon, wire, film or sheet.

27. A marker in accordance with claim 1, in combination with: means for generating an alternating magnetic interrogation field in an interrogation zone; and means for detecting the perturbation to said magnetic interrogation field resulting from said marker for activating an alarm.

28. A marker in accordance with claim 27, in further combination with:

means for deactivating the marker by causing the step change in flux to become a gradual change in flux.

29. A marker in accordance with claim 28 wherein: said deactivating means comprises means for applying a deactivating magnetic field to the marker.

30. A marker in accordance with claim 29 wherein: the amplitude of said deactivating magnetic field is equal to or above about an order of magnitude greater than the amplitude of said magnetic interrogation field.

31. A marker in accordance with claim 29 wherein: the frequency of said deactivating magnetic field is equal to or above an order of magnitude greater than the frequency of said magnetic interrogation field.

32. A marker in accordance with claim 1 further comprising:

means for attaching the marker to an article.

33. A method of making a marker, the marker to be used in an article surveillance system and being comprised of a magnetic means, the method comprising the steps of:

developing for the magnetic means domains having a wall configuration;

and annealing said magnetic means to cause said wall configuration of said domains to remain in a pinned state for values of applied field below a threshold value.

34. A method in accordance with claim 33 wherein: said step of developing includes demagnetizing said magnetic means;

and said step of annealing is carried out in an environment having a net magnetic field substantially equal to zero.

35. A method in accordance with claim 33 wherein: said step of developing includes applying a magnetic field to said magnetic means and maintaining fixed the spatial relationship between said magnetic means and said applied field;

and said step of annealing is carried out while said magnetic means and said applied magnetic field are retained in said fixed spatial relationship.

36. A method in accordance with claim 33 wherein: the developed domain wall configuration is such that, when said magnetic means is in a substantially demagnetized condition corresponding to a negligible flux, the wall configuration of the domains is in a pinned state and remains in a pinned state for increasing magnitudes of applied field up to the threshold value at which the wall configuration is released from the pinned state causing a regenerative step change in the magnetic flux, the wall configuration returning to the pinned state upon the magnitude of applied field being decreased below the threshold value to a value resulting in said demagnetized condition whereby said flux is gradually decreased to said negligible flux.

37. A method in accordance with claim 36 wherein: said annealing is carried out at a temperature in a range of 250° to 500° C. over a period of time in a range of 30 seconds to 5 minutes.

38. A method for detecting the presence of an article in an interrogation zone comprising the steps of:

generating an alternating magnetic interrogation field in the interrogation zone, the magnitude of said interrogation field in said interrogation zone exceeding a threshold value;

securing a marker to said article, the marker comprising a magnetic means having a hysteresis characteristic with a step change in magnetic flux such that upon subjecting the magnetic means to an applied alternating magnetic field, the magnetic flux of the magnetic means undergoes a regenerative step change in magnetic flux at a threshold value when the field increases to the threshold value from substantially zero and undergoes a gradual change in magnetic flux when the field decreases from the threshold value to substantially zero, the magnetic flux of the material undergoing substantially no change in flux value for increasing values of field below the threshold value;

and detecting perturbations of the interrogation field in said interrogation zone when said marker is present in said interrogation zone.

39. A method in accordance with claim 38 further comprising:

causing the step change in flux to become á gradual change, thereby deactivating the marker.

40. A method in accordance with claim 39 wherein: said step of causing comprises applying a deactivating magnetic field to the marker.

41. A method in accordance with claim 40 wherein: the amplitude of said deactivating magnetic field is equal to or above an order of magnitude greater than the amplitude of said magnetic interrogation field.

42. A method in a accordance with claim 40 wherein: the frequency of said deactivating magnetic field is equal to or above an order of magnitude greater than the frequency of said magnetic interrogation field.

43. A method in accordance with claim 38 wherein: said magnetic means has, when in a substantially demagnetized condition corresponding to a negligible flux, domains whose wall configuration is in a pinned state and remains in a pinned state for increasing magnitudes of applied field up to the threshold value at which the wall configuration is released from the pinned state causing a regenerative step change in the magnetic flux, the wall configuration returning to the pinned state upon the magnitude of applied field being decreased below the threshold value to a value resulting in said demagnetized condition whereby said flux is gradually decreased to the negligible flux.

44. A method in accordance with claim 43 further comprising:

disabling the wall configuration of the domains of said magnetic means from returning to its pinned state, thereby deactivating said marker.

45. A method in accordance with claim 44 wherein:

said disabling comprises applying a deactivating magnetic field to said marker.

46. A method in accordance with claim 45 wherein:

the frequency of said deactivating magnetic field is equal to or greater than about an order of magnitude greater than the frequency of said magnetic interrogation field, thereby resulting in said deactivating magnetic field disabling the wall configuration of said domains of said magnetic means from returning to its pinned state.

47. A method in accordance with claim 45 wherein:

the amplitude of said deactivating magnetic field is equal to or greater than about an order of magnitude greater than the amplitude of said magnetic interrogation field and is such as to cause the disabling of said pinned state.

48. A system for detecting the presence of an article in an interrogation zone comprising:

means for generating an alternating magnetic interrogation field in the interrogation zone, the magnitude of said interrogation field in said interrogation zone exceeding a threshold value;

a marker secured to an article, the marker comprising a magnetic means having a hysteresis characteristic with a step change in magnetic flux such that upon subjecting the magnetic means to an applied alternating magnetic field, the magnetic means undergoes a regenerative step change in magnetic flux at said threshold value when the field increases to the threshold value from substantially zero and undergoes a gradual change in magnetic flux when the field decreases from the threshold value to substantially zero, the magnetic flux of the material undergoing substantially no change in flux value for increasing values of field below the threshold value;

and means for detecting perturbations to the interrogation field in said interrogation zone when said marker is present in said interrogation zone.

49. A system in accordance with claim 48 further comprising:

means for causing the step change in flux to become a gradual change, thereby deactivating marker.

50. A system in accordance with claim 49 wherein:

said means for causing comprises means for applying a deactivating magnetic field to the marker.

51. A system in accordance with claim 50 wherein:

the amplitude of said deactivating magnetic field is equal to or above about an order of magnitude greater than the amplitude of said magnetic interrogation field.

52. A system in accordance with claim 50 wherein:

the frequency of said deactivating magnetic field is equal to or above about an order of magnitude greater than the frequency of said magnetic interrogation field.

53. A system in accordance with claim 48 wherein:

said magnetic means has, when in a substantially demagnetized condition corresponding to a negligible flux, domains whose wall configurations is in a pinned state and remains in a pinned state for increasing magnitudes of applied field up to the threshold value at which the wall configuration is released from the pinned state causing a regenerative step change in the magnetic flux, the wall configuration returning to the pinned state upon the magnitude of applied field being decreased below the threshold value to a value resulting in said demagnetized condition whereby said flux is gradually decreased to the negligible flux.

54. A system in accordance with claim 53 further comprising:

means for disabling the wall configuration of the domains of said magnetic means from returning to its pinned state, thereby deactivating said marker.

55. A method in accordance with claim 54 wherein:

said disabling comprises applying a deactivating magnetic field to said marker.

56. A system in accordance with claim 55 wherein:

the frequency of said deactivating magnetic field is equal to or greater than about an order of magnitude greater than the frequency of said magnetic interrogation field.

57. A system in accordance with claim 55 wherein:

the amplitude of said deactivating magnetic field is equal to or greater than about an order of magnitude greater than the amplitude of said magnetic interrogation field.

58. A method of deactivating an article surveillance marker, the marker comprising a magnetic material having domains whose wall configuration is of a character that, in the absence of deactivation, enables the marker to be responsive to an applied alternating magnetic interrogation field for causing an associated article surveillance system to render an output alarm, the method comprising:

disabling the character of said wall configuration of said domains.

59. A method in accordance with claim 58 wherein:

said disabling includes applying a deactivating magnetic field to said marker.

60. A method in accordance with claim 59 wherein:

the frequency of said deactivating magnetic field is equal to or greater than about an order of magnitude greater than the frequency of said magnetic interrogation field.

61. A method in accordance with claim 59 wherein:

the amplitude of said deactivating magnetic field is equal to or greater than about an order of magnitude greater than the amplitude of said magnetic interrogation field.

62. A method in accordance with claim 58 wherein:

the wall configuration of the domains is of a character such that, when said magnetic material is in a substantially demagnetized condition corresponding to a negligible flux, the wall configuration is in a pinned state and remains in a pinned state for increasing magnitudes of applied field up to a threshold value at which the wall configuration is released from the pinned state causing a regenerative step change in the magnetic flux, the wall configuration returning to the pinned state upon the magnitude of applied field being decreased below the threshold to a value resulting in said demagnetized condition whereby said said flux is gradually decreased to the negligible flux.

63. A marker for use in an article surveillance system in which an alternating magnetic interrogation field is established in a surveillance zone and an alarm is activated when a predetermined perturbation to said field is detected, said marker comprising a magnetic material having, when in a substantially demagnetized condition corresponding to a negligible flux, domains whose wall configuration is in a pinned state and remains in a pinned state for increasing magnitudes of applied field up to a threshold value at which the wall configuration is released from the pinned state causing a regenerative step change in the magnetic flux, the wall configuration of the domains returning to the pinned state upon the magnitude of applied field being decreased below the threshold value to a value resulting in said demagnetized condition whereby said flux is gradually decreased to the negligible flux.

64. A marker in accordance with claim 63 wherein: the wall configuration of the domains is disabled from returning to its pinned state after said magnetic material is subjected to an applied field above a predetermined frequency.

65. A marker in accordance with claim 63 wherein: the wall configuration of the domains is disabled from returning to its pinned state after said magnetic material is subjected to an applied field above a certain amplitude.

66. A marker in accordance with claim 63 wherein: the demagnetizing field of said magnetic means is equal to or slightly less than said threshold value.

67. A marker in accordance with claim 66 wherein: said demagnetizing field is in a range of 0.5 to 0.8 oersted.

68. A marker in accordance with claim 63 wherein: said threshold value is below about 1.0 oersted.

69. A marker in accordance with claim 68 wherein: said threshold value is in the range of 0.5 to 1.0 oersted.

* * * * *